United States Patent [19]

Settle et al.

[11] 3,948,185

[45] Apr. 6, 1976

[54] METHOD AND APPARATUS FOR REMOVING RAILROAD TIES

[75] Inventors: Paul S. Settle, Fox Chapel; Rudolph G. Wilmer, Glenshaw, both of Pa.

[73] Assignee: Railway Maintenance Corporation, Pittsburgh, Pa.

[22] Filed: Jan. 20, 1975

[21] Appl. No.: 542,577

[52] U.S. Cl. ..... 104/9; 105/28; 254/43

[51] Int. Cl.[2] ..... E01B 29/06

[58] Field of Search ..... 104/2, 6, 9, 45; 171/16; 254/43, 44; 404/115, 116; 105/28; 37/104

[56] References Cited

UNITED STATES PATENTS

| | | | |
|---|---|---|---|
| 1,337,914 | 4/1920 | Hyden | 105/28 |
| 2,382,096 | 8/1945 | Pierce | 404/115 |
| 2,899,759 | 8/1959 | Campbell | 171/16 X |
| 3,436,848 | 4/1969 | Peppin et al. | 171/16 X |
| 3,457,660 | 7/1969 | Speno | 171/16 X |
| 3,496,883 | 2/1970 | Bodine | 104/9 |
| 3,537,400 | 11/1970 | Taylor | 104/9 |
| 3,780,664 | 12/1973 | Holley et al. | 104/9 |

*Primary Examiner*—Robert J. Spar
*Assistant Examiner*—Randolph A. Reese

[57] ABSTRACT

Method for undercutting a railroad tie resting in a ballast bed and supporting track rails consisting of moving a probe through the ballast beneath the tie while continuously vibrating the probe so that forces are transmitted from the probe to the ballast to agitate the ballast adjacent to the bottom and side faces of the tie to remove ballast from beneath the tie to form a trench substantially coincident with the bottom of the tie and to loosen ballast immediately adjacent the side faces of the tie and apparatus for carrying out the method.

13 Claims, 9 Drawing Figures

METHOD AND APPARATUS FOR REMOVING RAILROAD TIES

This invention relates generally to removing railroad ties and more particularly to a method and apparatus for undercutting a tie by imparting rapid agitation to the ballast located adjacent a railroad tie to move the ballast and loosen the tie to facilitate removal of the tie and insertion of a new tie.

Replacement of individual ties supporting railroad track rails is often necessary because ties deteriorate from constant traffic over the track rails, from inclement weather and from other conditions which reduce the structural strength of the tie. The replacement of a tie has been a difficult operation since an essential requirement for a seated tie is that the ballast be compacted around it to create a resistance to movement of the tie and the track attached thereto. In the past ties requiring replacement have been removed by pushing or pulling them from beneath the track rails in one piece or by cutting out a section between the rails and removing it and then removing the end sections. Pushing or pulling a tie from beneath the rails is difficult because pieces of ballast are partially embedded in the bottom and side faces of the tie so that considerable force is required to remove the tie from the ballast bed. The use of a large force to remove a tie from the ballast beneath the track rails often causes the rails to move laterally, and the rails may be shifted to such an extent that when a new tie is placed in position and the rails are attached thereto, the track does not resume its original lined position and an irregular track condition is created. The force required to push or pull a tie out of the ballast may be reduced by raising the track and the tie to free the tie from embedded ballast, but this is disadvantageous because the seat of adjacent ties in the ballast bed is disturbed. Removal of a tie in separate sections does not shift or raise the track rails or unsettle adjacent ties but is inefficient and time consuming. Since removal of a tie in sections does not loosen the ballast, the tie bed must be scarified prior to inserting a new tie to form a hole for the new tie. Scarification decreases the overall bearing capacity of the ballast bed because it reduces the compaction of the ballast which has been imparted to the ballast by continuous passage of trains over the rails. Reduction of the overall ballast compaction decreases the ability of the track rails to resist the lateral forces transmitted to the rails by continuous high speed traffic and a dynamic load passing over the rails can cause the track to buckle.

The method and apparatus of our invention permits rapid and inexpensive removal of individual railroad ties from beneath the track rails without disturbing the location of the track. By utilizing our invention, the ballast beneath a tie and adjacent the side faces of a tie is loosened so that substantially no ballast remains embedded in or compacted tightly against the surfaces of the tie. Additionally, the ballast beneath the tie is removed to form a trench coincident with the tie so that when the probe is removed, the tie can be knocked down into the trench prior to being removed from beneath the rails. This is advantageous since the tie can be removed with a minimum of force without the bases of the rails contacting the tie or the tie plates. When a tie has been removed after undercutting according to our invention, the trench remains in the ballast and a new tie may be inserted into the trench without materially disturbing the bearing quality of the tie bed.

The apparatus of our invention includes a probe for insertion beneath a tie while continuous vibration is imparted to the probe. Insertion of the vibrating probe along the length of a tie removes the ballast from beneath the tie to create a trench substantially coincident with the tie and loosens the ballast adjacent the side faces of the tie so that the tie may be easily pushed or pulled from the ballast. The probe has a cutting tip at its free end and a vibration exciter mounted adjacent the opposite end to impart vibrations to the probe. The probe is approximately the same length and width as a standard railroad tie so that the trench is cut throughout the length and width of the undercut tie. A pair of upstanding guide members may be attached adjacent the probe tip to insure that the tip does not wander and become skewed relative to the longitudinal axis of the tie as a result of encountering hard packed ballast. The guide members will also assist in loosening ballast along the side faces of a tie.

Vibration is imparted to the probe by a conventional exciter mounted adjacent the end of the probe. The operating speed of the vibration exciter may be adjusted according to the characteristics of the probe to transmit vibrations to the probe at or near resonance although it should be understood that the probe does not have to vibrate at or near its resonant frequency in order to fulfill the objects of our invention. The vibration exciter continuously transmits energy to the probe, and, as a result thereof, the cutting tip continuously agitates the ballast beneath and adjacent the tie. The use of a vibrating probe results in efficient and rapid undercutting of the tie since large forces which readily agitate the ballast are continuously transmitted to the ballast by the probe. By utilizing the vibrating probe tip to agitate the ballast adjacent the tie, the track is not shifted laterally when the tie is removed and, therefore, need not be lined after a tie is removed and a new tie inserted. Additionally, it is necessary to hump or lift the track during tie removal so that the track does not have to be surfaced after a new tie is inserted. Thus, the expense and time required to replace worn ties are minimized and the original track condition is retained.

Other objects of our invention will become apparent from the following description taken in connection with the accompanying drawings in which.

Figure 1:
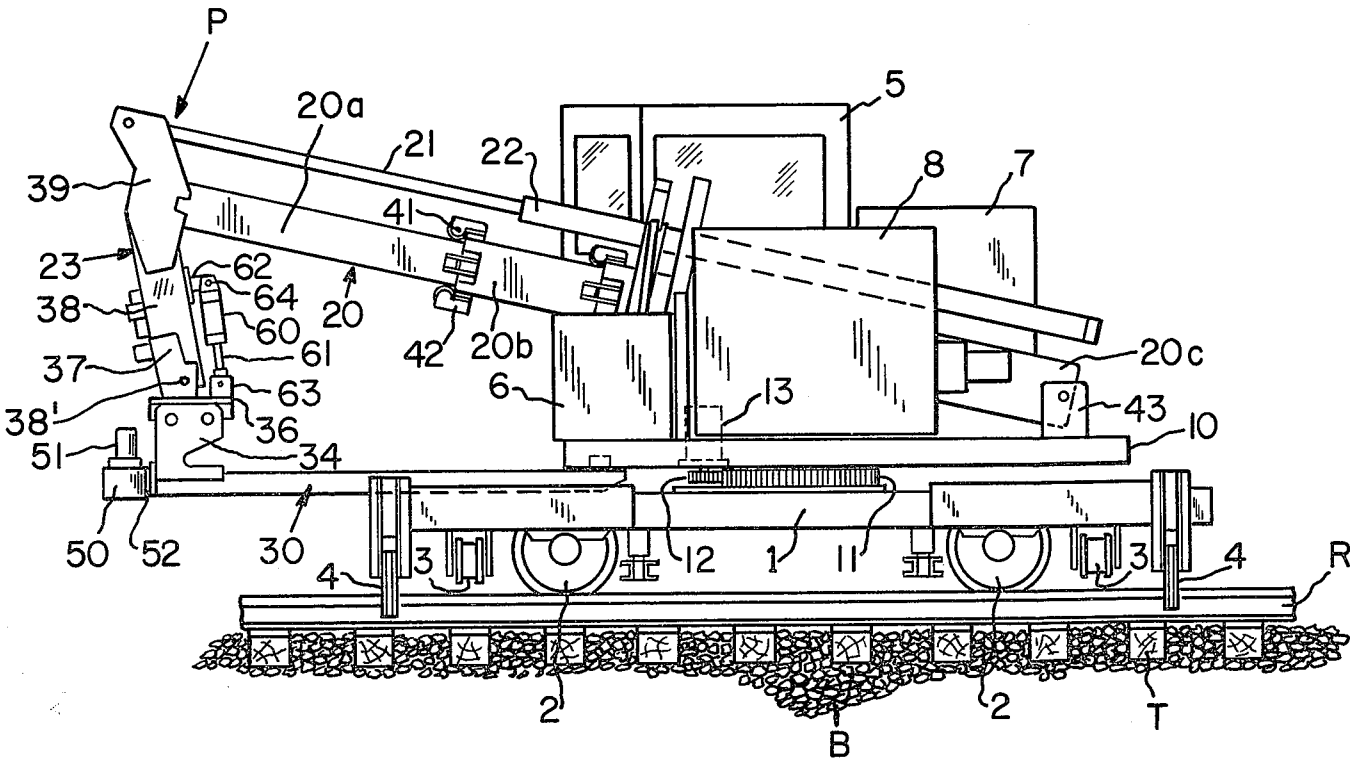
FIG. 1 is an elevation of the apparatus.
Figure 2:
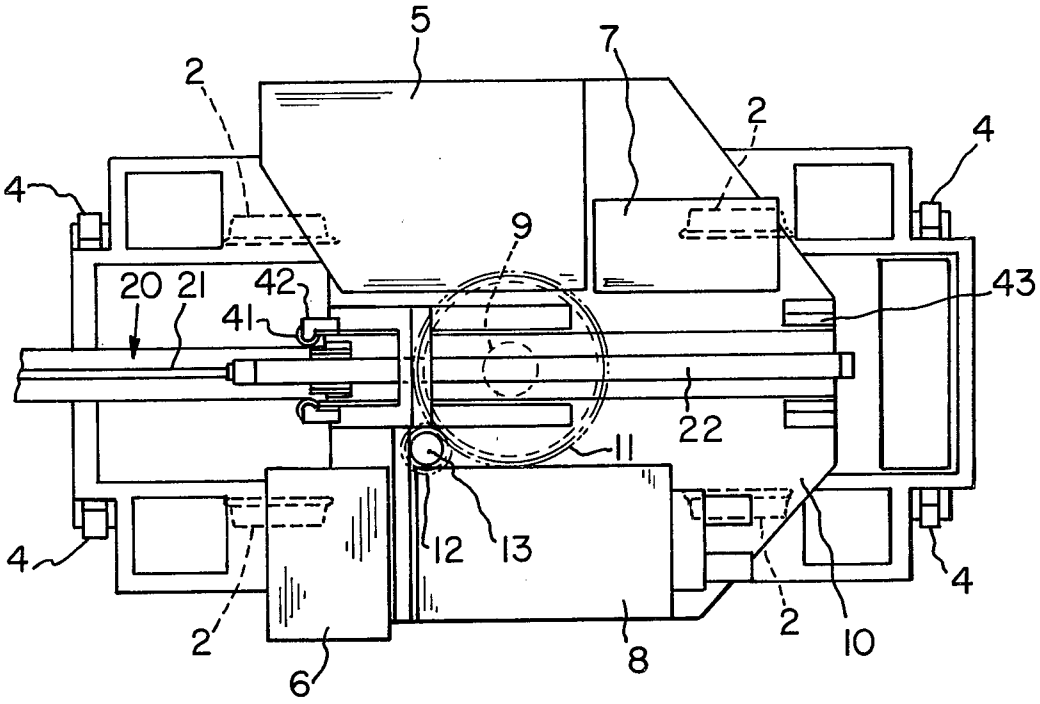
FIG. 2 is a plan view of the apparatus with the probe assembly broken away.
Figure 3:
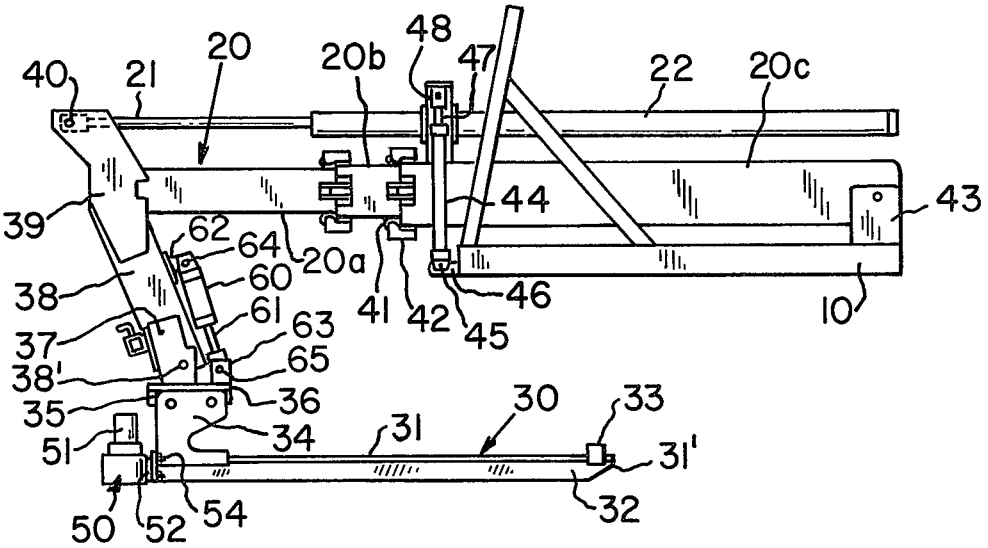
FIG. 3 is an elevation of the probe assembly.

As shown in FIG. 1, our apparatus consists of a main frame 1 having axles carrying flanged wheels 2 adapted to travel along rails R fastened to ties T. The rails are supported by standard tie plates held in position by spikes (not shown) and the ties are supported in ballast B in accordance with normal railroad construction. The main frame carries setoff wheels 3 adapted to cooperate with a standard setoff frame for removing the machine from the main track and rail clamps 4 to clamp the machine onto the track. The setoff wheels and rail clamps are well known and form no part of our invention.

A rotatable platform 10 is located above frame 1 and is supported on a bearing 9 mounted above frame 1 on a stationary gear 11. Bearing 9 is aligned with the center line of gear 11 which is fixed to main frame 1. A pinion gear 12 driven by a motor 13 is supported on platform 10 and engages with gear 11. Rotation of gear 12 by motor 13 relative to gear 11 rotates platform 10 on bearing 9. Platform 10 also carries an operator's cab 5, a fuel tank 6, a hydraulic tank 7 and an engine 8. The probe assembly, generally designated P, is mounted on platform 10 and includes the probe and the probe supporting structure.

Figure 5:
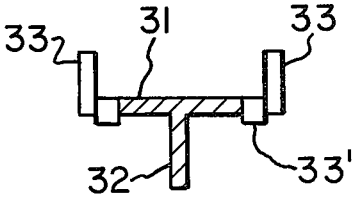
FIG. 5 is a section on line V—V of FIG. 4.

The probe supporting structure includes a telescoping boom 20, a rod 21, a cylinder 22 and a connecting arrangement indicated by numeral 23 extending between the free ends of boom 20 and rod 21 and the probe. Probe 30 is T-shaped in cross section, as shown in FIG. 5, with a base member 31 adapted to extend parallel to the bottom of a tie and a web member 32 connected to member 31 at the longitudinal center line thereof to stabilize the probe. The length and width of base member 31 are substantially the same as the length and width of the bottom of a standard tie for reasons explained hereinafter. While a T-shaped probe is shown in FIG. 5, it will be understood that the cross section shape is nt critical and other shapes may be used. For example, an H-shape or an inverted U-shape may also be used.

Figure 4:
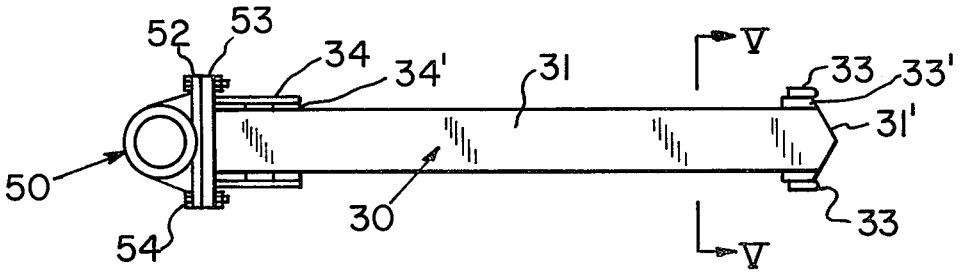
FIG. 4 is a plan view of the probe and the exciter.

As shown in FIG. 4, the probe is formed with a V-shaped tip 31' at the free end to facilitate penetration of the probe through the ballast. The free end of the probe carries upwardly extending guide members 33 welded to spacers 33' which are welded to opposite edges of base member 31 adjacent tip 31'. Mounting brackets 34 are welded to spacers 34' which are welded to opposite edges of base member 31 at the end of probe 30 opposite tip 31'. The upper portion of each bracket 34 is attached to a lug 35 extending downwardly from a mounting plate 36, and resilient mounting means (not shown) are utilized between brackets 34 and lugs 35 to minimize the transfer of vibrations from the probe to the rest of the machine. Spaced lugs 37 extend upwardly from plate 36 and an elongated hollow member 38 is pivotally attached to lugs 37 by pins 38'. The upper end of member 38 is fixed to spaced members 39 which are attached to the free ends of boom 20. A pin 40 extends between the upper ends of members 39 and a socket at the free end of rod 21.

Boom 20 is constructed of sections 20*a*, 20*b* and 20*c* which are dimensioned to slide relative to each other when the boom is extended or retracted. In order to facilitate relative movement of sections 20*a*, 20*b* and 20*c*, the ends of sections 20*b* and 20*c* carry brackets 42 supporting rollers 41 which slidably support sections 20*a* and 20*b*. Additionally, there are complimentary rollers (not shown) on the inside sections of 20*a* and 20*b* to facilitate relative movement of these sections. Movement of rod 21 relative to cylinder 22 moves section 20*a* relative to 20*b* and section 20*b* relative to 20*c*.

Section 20*c* is pivotally attached at one end to upstanding spaced lugs 43 on platform 10. Lift cylinders 44 are pivotally attached to lugs 46 by pins 45 extending through the lugs and the ends of the cylinders. Rods 47 extend from lift cylinders 44, and each rod is pivotally attached at its upper end to a bracket 48 which is welded to section 20*c* of boom 20. Bracket 48 is fixed to cylinder 22 so that the cylinder and the boom are fixedly spaced in parallel relation to each other. Extension of rods 47 from cylinders 44 pivots the boom about its pivot connection with lugs 43 to raise the boom and adjust the position of the probe relative to platform 10 and to the ties.

The end of probe 30 opposite tip 31' carries a vibration exciter 50 which is driven by any suitable power means 51. The exciter and the power means therefore are of known construction, and the details thereof form no part of our invention. The exciter includes a mounting plate 52 formed as a part thereof, and this plate is bolted to a backing plate 53 by bolts 54. The backing plate is welded to the end of probe 30 so that connection of plates 52 and 53 rigidly connects the exciter 50 to the probe. The exciter transmits energy to the probe so that continued penetration of the probe tip may be obtained. It will be understood that the frequency of the exciter may be adjusted to vibrate the probe at or near a natural resonant frequency of the probe or the frequency of vibration may be nonresonant. In either case, a large alternating force is developed at the probe tip to agitate compacted ballast and remove it from beneath the tie and to loosen it adjacent the side faces. Guides 33 at the penetrating tip of the probe insure that the probe remains substantially completely beneath the tie while undercutting so that a trench will be cut substantially completely below the tie rather than at an angle to the tie. The probe can be used without guides, but if a probe tip without guides encounters a section of relatively hard packed ballast beneath a tie, it will follow the path of least resistance through the ballast and skew away from the hard packed ballast. If this occurs, the trench will not be cut below the tie throughout the length of the tie.

It is essential that the probe is continuously vibrated as it penetrates through the ballast bed. The amplitude of probe tip movement will vary to some extent depending upon the characteristics of the ballast, but regardless of the variation, there must be sufficient amplitude and frequency of vibration to permit the probe to rapidly penetrate through the ballast and effectively agitate the ballast and undercut a tie. The amplitude of the movement of the tip of the probe is basically in the lateral plane, and the probe will transmit substantially horizontal forces to the ballast. Hence, the rails are not elevated during undercutting which is advantageous since it is not necessary to surface the track after a tie has been replaced. The probe laterally displaces ballast from directly beneath the tie and loosens ballast immediately adjacent to the vertical faces of the tie so that it is preferred to compact the crib ballast after a tie has been replaced immediately adjacent and below the new tie so that it supports vertically imposed loads.

Figure 7:
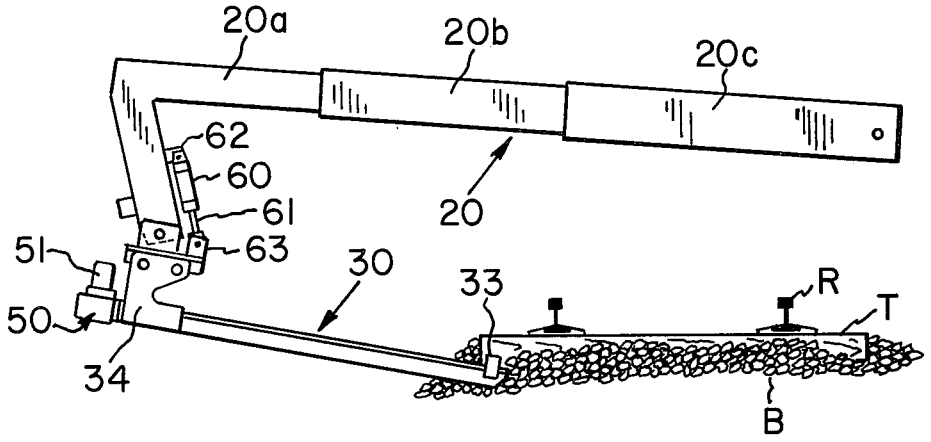
FIGS. 7–9 are schematic elevations showing the probe in various operating positions relative to a tie and the ballast bed.
Figure 8:
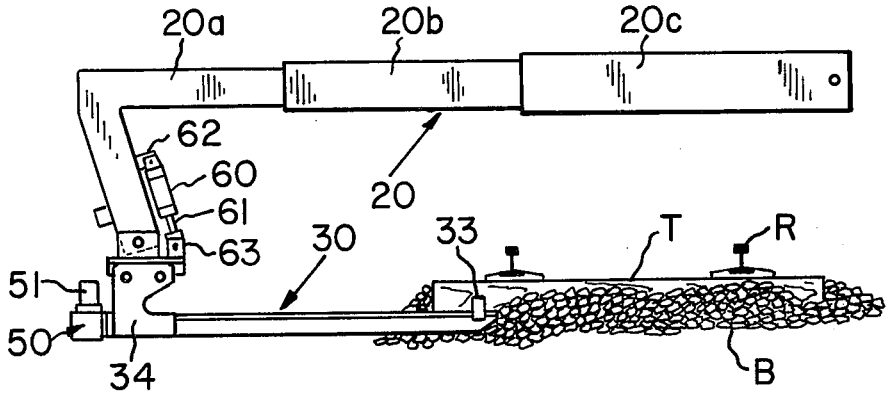

A hydraulic cylinder 60 having a rod 61 is pivotally connected to a bracket 62 welded to member 38 by a pin 64, and the free end of rod 61 is pivotally connected to a pair of spaced lugs 63 on plate 36 by a pin 65. When rod 61 is extended from cylinder 60, the tip of the probe is moved in an arcuate downward direction relative to the end of a tie to position the probe for insertion beneath the tie. The initial probe tip undercutting position is illustrated in FIG. 7. When rod 61 is contracted into cylinder 60, the tip of the probe is raised, and when boom 20 is lowered the probe will be positioned substantially parallel to boom 20 and to the tie as shown in FIG. 8.

Figure 6:
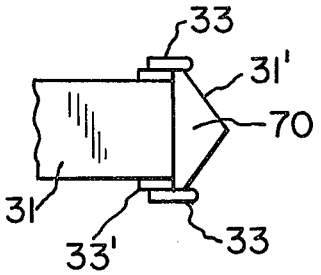
FIG. 6 is a partial plan view of a modified probe adapted to remove a tie after it has been undercut.

A modified embodiment of our invention is shown in FIG. 6 wherein the probe is adapted to remove a tie from beneath the rails after the trench has been cut. In order to adapt the probe for tie removal, an upwardly projecting lip 70 having the same configuration as tip 31' is affixed to the top surface of the probe immediately above the tip. In operation, when a tie is to be removed, the vibrating probe is moved beneath the tie to loosen and remove ballast, and when the probe has passed completely beneath the tie, one end of the tie will be located between the brackets 34 and the other end will be located between the guide members 33. The end of the tie at tip 31' is then knocked down so that lip 70 is above the bottom surface of the tie. Cylinder 22 is now actuated to extend rod 21 and withdraw the probe which brings lip 70 into contact with the end of the tie and pulls it from beneath the rails. Vibration of the probe is continued during tie removal.

Figure 9:
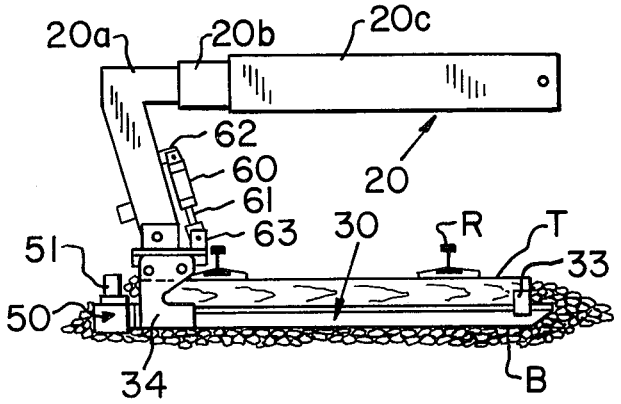

In our method it is important that the probe is vibrating when inserted into the ballast since the energy transmitted to the probe is transferred to the ballast and makes it easier to insert. Vibration is initiated and the probe tip is moved into the position shown in FIG. 7. The probe is then moved angularly by adjusting rods 47 in cylinders 44 and rod 61 in cylinder 60 until the probe is parallel with the tie as shown in FIG. 8. The probe is then moved longitudinally beneath the tie by contracting boom 20 with rod 21 in cylinder 22, and the continued vibration provides for easy and rapid movement of the probe tip through the ballast beneath the tie until it reaches the position shown in FIG. 9. An advantage of our apparatus is that when the vibration exciter is actuated, there is adequate amplitude at the probe tip to undercut a tie even through hard packed ballast.

In operation, platform 10 is rotated by pinion gear 12 until the probe is aligned with the tie to be undercut. The platform will remain in this position during undercutting. After the platform is positioned, the probe tip is moved adjacent to the tie and the vibration exciter is actuated to initiate vibration of the probe tip. The outer end of the probe is then lowered into the position shown in FIG. 7 by retracting rod 21 into cylinder 22 to adjust boom 20 longitudinally. Further adjustment of the probe is effected by cylinders 44 and 60 until the probe is parallel with the tie. The probe is then moved beneath the tie by contracting rod 21 into cylinder 22. After the trench is cut beneath the tie, vibration is continued and the probe is removed. The tie then drops or is knocked down into the trench and may readily be pushed or pulled from under the rails. Since the ballast has been removed beneath the old tie to form a trench, a new tie may be easily inserted under the rails. As an alternative to knocking the tie into the trench, the tie may be removed by the modified arrangement shown in FIG. 6.

Mounting the probe assembly on a rotatable platform is important since it is necessary that the probe be capable of entering the ballast from either side of the track. Additionally, by making the probe assembly rotatable relative to the main frame, skewed ties can be easily undercut. Furthermore, a section of track can be worked on adjacent to a second track while permitting trains to run on the second track without interference by the tie undercutting machine since the probe movement is such that in most instances the probe can operate within minimum side clearances.

While we have shown and described preferred embodiments of our invention, it will be understood that it is embodied within the following claims.

We claim:

1. Apparatus for undercutting a railroad tie comprising: a vehicle having a main frame and flanged rail wheels mounted on said main frame adapted to travel along the rails of a railroad track supported on spaced ties resting in ballast; a platform located above said main frame and means mounting said platfrom on said main frame for rotation relative to said main frame; means for rotating said platform; a probe assembly mounted on said platform, said probe assembly including an elongated probe adapted to penetrate through the ballast below a tie, means for adjustably supporting said probe for movement relative to said platform and vibration exciter means attached adjacent one end of said probe to impart vibrations to said probe, whereby said probe is continuously moved through ballast beneath a tie while vibrations are imparted to said probe by said vibration exciter means to vibrate ballast adjacent to said probe to loosen ballast and form a trench beneath the tie and coincident therewith.

2. Apparatus as set forth in claim 1 including a stationary gear fixed to said main frame and said means for rotating said platform is a driven gear carried on said platform engaging said stationary gear and drive means for rotating said driven gear to rotate said platform relative to said stationary gear and said main frame.

3. Apparatus as set forth in claim 1 wherein said means for adjustably supporting said probe includes a first means for raising and lowering said probe relative to said platform, a second means for moving said probe substantially linearly relative to said platform and a third means for varying the angular relationship between said probe and said platform.

4. Apparatus as set forth in claim 3 wherein said first means comprises a power cylinder pivotally mounted at one end on said platform and a rod extending between the other end of said cylinder and connected to said second means, whereby movement of said rod relative to said cylinder moves said second means and said probe relative to said platform to position the probe relative to a tie.

5. Apparatus as set forth in claim 3 wherein said second means comprises a telescoping boom having a plurality of sections connected for sliding movement relative to each other, one end section of said boom being pivotally attached to said platform and the opposite end section supporting a depending connecting arrangement attached adjacent to the end of said probe carrying said vibration exciter, a power cylinder mounted on the end section of the boom pivotally attached to said platform and a rod extending from said cylinder substantially parallel to said boom and attached to a member of said connecting arrangement, whereby movement of said rod relative to said power cylinder moves said plurality of sections of the boom relative to one another to change the length of said boom and move said probe substantially linearly relative to said platform to position the probe relative to a tie.

6. Apparatus as set forth in claim 5 wherein said probe has a pair of upstanding brackets attached thereto and said connecting arrangement includes a mounting plate attached to said brackets, said connecting arrangement also including a member fixed to said boom and pivot means between said member and said mounting plate; said third means comprising a power cylinder pivotally attached at one end to said member and a rod extending from the other end of said cylinder and attached to said mounting plate, whereby movement of said rod relative to said cylinder pivots said mounting plate, said brackets and said probe about said pivot means relative to said boom to vary the angular relationship between said probe and said boom.

7. Apparatus as set forth in claim 6 wherein said brackets are attached to opposite edges of said probe at the end of the probe opposite said cutting tip so that the end of a tie can fit between said brackets when the probe is located completely beneath the length of a tie.

8. Apparatus as set forth in claim 1 wherein said probe includes a cutting tip at the end opposite to the end carrying the exciter and a pair of spaced upstanding guide members attached to opposite edges of said probe adjacent to said cutting tip, said guide members being adapted to contact opposite side faces of a tie when said probe is moved beneath the tie to maintain the probe tip substantially below the tie throughout the length of the tie.

9. Apparatus as set forth in claim 8 wherein said probe includes means to engage a tie for removal of the tie from ballast beneath the railroad track.

10. Apparatus as set forth in claim 9 wherein said means to engage a tie is an upstanding lip attached to the upper surface of said probe at right angles to the longitudinal axis of said probe adjacent said tip.

11. A method of undercutting a railroad tie resting in a ballast bed and supporting track rails comprising: rapidly agitating ballast below and adjacent the side faces of the tie throughout the length of the tie to remove ballast from below the tie to form a trench coincident with the tie and to loosen ballast embedded in the side faces of the tie permitting the undercut tie to drop into said trench by gravity and to be removed from the ballast bed without either raising or laterally shifting the track rails.

12. A method of undercutting a railroad tie resting in a ballast bed and supporting track rails comprising penetrating the ballast bed at one end of a tie and immediately below the tie, imparting rapid agitation to the ballast, continuously agitating the ballast below the tie and adjacent the side faces of the tie to remove ballast from below the tie coextensive with the width of the tie and to loosen ballast embedded in the side faces of the tie, penetrating the ballast throughout the length of the tie and continuing said agitation of the ballast during penetration to remove ballast throughout the length and width of the tie and to loosen ballast embedded in the side faces of the tie from one end of the side faces to the other, whereby a trench is formed substantially coextensive with the length and width of the tie.

13. The method of claim 12 including removing the tie from the ballast without either raising or laterally shifting the track rails.

* * * * *